US007533681B2

(12) United States Patent
Miller

(10) Patent No.: US 7,533,681 B2
(45) Date of Patent: May 19, 2009

(54) COLLAPSIBLE STRUCTURAL FRAME

(76) Inventor: Stephen F. Miller, 2338 Glenneyre, Laguna Beach, CA (US) 92651

( * ) Notice: Subject to any disclaimer, the term of this patent is extended or adjusted under 35 U.S.C. 154(b) by 0 days.

(21) Appl. No.: 11/927,132

(22) Filed: Oct. 29, 2007

(65) Prior Publication Data

US 2008/0115816 A1 May 22, 2008

Related U.S. Application Data

(63) Continuation of application No. 10/726,003, filed on Nov. 12, 2003, now abandoned, which is a continuation of application No. 09/841,649, filed on Apr. 23, 2001, now Pat. No. 6,748,962.

(51) Int. Cl.
*E04H 15/48* (2006.01)
*E04B 1/32* (2006.01)

(52) U.S. Cl. ..... 135/130; 135/127; 135/123; 135/120.3; 135/144; 52/81.3; 52/645

(58) Field of Classification Search ..... 135/121, 135/123, 127, 120.3, 120.4, 130, 135, 137, 135/144, 157; 52/81.1, 81.3–81.5, 641, 645–646, 52/656.9; 411/117, 119, 126
See application file for complete search history.

(56) References Cited

U.S. PATENT DOCUMENTS 3,059,658 A 10/1962 Finlayson
3,333,375 A * 8/1967 Johnston ..... 52/81.3
3,502,091 A 3/1970 Corbin
3,710,806 A 1/1973 Kelly et al.
3,771,274 A 11/1973 Vaughan
3,810,482 A 5/1974 Beavers
3,968,808 A 7/1976 Zeigler (Continued)

FOREIGN PATENT DOCUMENTS

CH 638581 A5 9/1983
JP 04216734 A * 8/1992

OTHER PUBLICATIONS

Reply To Office Action And Amendment After Final Office Action of Feb. 14, 2007 re U.S. Appl. No. 10/726,003.

(Continued)

*Primary Examiner*—Winnie Yip
(74) *Attorney, Agent, or Firm*—John J. Connors; Connors & Assoc.

(57) ABSTRACT

An apparatus and method is disclosed for providing a collapsible support structure strut, which may include a strut member; a hollow tubular terminal end portion of the strut member having an inner surface; and a detachable looped eyelet having at least one loop and a pair of extending legs, the legs being springedly biased to engage the tubular terminal end of the strut, thereby frictionally holding the looped eyelet in place at the terminal end of the strut. The apparatus and method may also employ a holding plug, with first and second holding groove opposingly placed in the periphery of the holding plug, having at least a portion thereof that is shaped and sized to frictionally engage the inner surface of the tubular terminal end of the strut, to frictionally hold the holding plug in engagement with the strut. The detachable looped eyelet may also have at least two loop.

20 Claims, 12 Drawing Sheets

U.S. PATENT DOCUMENTS

| | | | | | |
|---|---|---|---|---|---|
| 4,026,313 | A | | 5/1977 | Zeigler | |
| 4,074,682 | A | | 2/1978 | Yoon | |
| 4,393,887 | A | | 7/1983 | Orribin | |
| 4,438,876 | A | | 3/1984 | Ward | |
| 4,583,956 | A | | 4/1986 | Nelson | |
| 4,667,451 | A | | 5/1987 | Onoda | |
| 4,809,726 | A | | 3/1989 | Gillis | |
| 4,876,831 | A | * | 10/1989 | Runyon | 52/70 |
| 4,998,552 | A | | 3/1991 | Niksic et al. | |
| 5,016,418 | A | | 5/1991 | Rhodes et al. | |
| 5,125,206 | A | | 6/1992 | Motohashi et al. | |
| 5,165,207 | A | | 11/1992 | Oehlke | |
| 5,423,341 | A | | 6/1995 | Brady | |
| 5,632,293 | A | | 5/1997 | Carter | |
| 5,797,412 | A | | 8/1998 | Carter | |
| 5,871,026 | A | | 2/1999 | Lin | |
| 5,930,971 | A | | 8/1999 | Etheridge | |
| 6,028,570 | A | | 2/2000 | Gilger et al. | |
| 6,089,247 | A | | 7/2000 | Price | |
| 6,748,962 | B2 | | 6/2004 | Miller | |

OTHER PUBLICATIONS

Applicant's Brief, re U.S. Appl. No. 10/726,003.

Examiner's Answer Before Board Of Patent Appeals And Interferences, mailed Jun. 25, 2007.

Hugh Kenner, Geodesic Math And How To Use It, Cover page of book, Exerpt: "What This Book Is", and pp. VIII-XI.

Notice Of Search Report/Written Opinion PCT/US2007/73601.

Decision of Board in U.S. Appl. No. 10/726,003.

* cited by examiner

COLLAPSIBLE STRUCTURAL FRAME

This is a continuation of application Ser. No. 10/726,003, filed on Nov. 12, 2003 now abandoned, which is a continuation of application Ser. No. 09/841,649, filed on Apr. 23, 2001, now U.S. Pat. No. 6,748,962, and claims the benefit of the filing dates of these applications.

RELATED APPLICATIONS

The present invention is related to the application entitled COLLAPSIBLE STRUCTURAL FRAME STRUT WITH POP-IN-CONNECTOR, filed on the same date as the present invention with the same inventor and under the disclosure of which is hereby incorporated by reference.

FIELD OF THE INVENTION

The present invention relates to the field of collapsible support structures.

BACKGROUND OF THE INVENTION

It is well known in the art to provide collapsible support structures for a variety of applications, e.g., supporting other structures, e.g., expandable antennae, e.g., for transportation into and use in outer space, ease of construction of relatively rigid building frames, and supporting such things as tents and other structures having forms composed of panels of material, e.g., cloth, canvas, plastic or other pliable fabrics and fabric-like material, including synthetics, e.g., Orlon, Gore-Tex and the like.

U.S. Pat. Nos., 3,968,808 and 4,026,313, each entitled COLLAPSIBLE SELF-SUPPORTING STRUCTURE, issued to Ziegler, respectively on Jul. 13, 1976 and May 31, 1977 each disclose collapsible structural support frames having a geodesic form. The '808 patent discloses: " . . . a collapsible, self-supporting structure is disclosed wherein the structure is made up of a network of rod elements pivotally joined at their ends and forming scissors-like pairs in which rod element crossing points are pivotally joined. The network consists of a plurality of pairs of inner and outer apical points where groups of radiating rods are pivotally joined. The outer apical points lie on a surface of revolution such as a spherical section and each group of rods radiating from an inner apical point lie essentially in a common plane whereby to effect the self-supporting action. For any pair of apical points the group of rods defining the inner apical point radiate in their common plane and join rods of other groups at the surrounding outer apical points." Abstract. The '808 patent states that " . . . a preferred universal pivotal connection at the apical points is illustrated in FIGS. 12-14. As shown, each element has a double-ended fan flot 130 through which a wire ring 132 passes so as to allow universal movement of the rod elements. In the embodiment of FIG. 1, there may be as few as three elements intersecting at an apical point and as many as six elements, as shown." Col 5, line 66—Col. 6, line 4. The '808 patent also notes that: " . . . referring more particularly at this time to FIG. 25, certain principles of the construction according to FIG. 1 will be apparent therefrom. The FIG. 1 construction may be further explained in terms of conventional geodesic nomenclature. Specifically, the FIG. 1 embodiment is constructed as a four frequency icosahedron in which one of the triangular regions is illustrated in FIG. 25 and, in FIG. 26, all of the triangular regions are shown but laid out in flat form so as to give a better understanding of the elements involved." Col. 7, lines 53-61. Similarly, the '313 patent discloses a " . . . self-supporting structures and panels of diverse shapes are disclosed in which basic assemblies of crossed rod elements are employed to achieve the desired shape. Further, the crossing points of crossed rod elements in the structure involved may include limited sliding connections which effect transfer of collapsing force to other crossing points which are pivotally joined. An improved hub structure for pivotally joining ends of the rod elements at the outer and inner apical points is also disclosed." Abstract.

U.S. Pat. No. 6,089,247 " . . . a collapsible frame for use in erecting tents, insect screen rooms, shade awnings, canopies and the like at camp sights, back yard patios and other outdoor venues. The collapsible frame includes a plurality of telescopic legs for providing vertical structural support and a plurality of corner pin joints with one of the pin joints fixedly mounted upon a corresponding one of each of the telescopic legs. A plurality of horizontal support arms is included with one of the arms positioned between every adjacent pair of telescopic legs and attached to the corresponding corner pin joints. A mid-span hinge which includes a sliding sleeve is centrally positioned along each of the horizontal support arms. The mid-span hinge is flexibly collapsible when the sleeve is disengaged and is rigidly inflexible when the sleeve is engaged. A bottom slider is adjustably mounted upon each of the telescopic legs and is attached to the horizontal support arms which are connected to the corresponding corner pin joint. Finally, a plurality of top support members is included where each is anchored in a corresponding corner pin joint for stabilizing the frame. In the present invention, the telescopic legs, mid-span hinges and bottom sliders each cooperate to collapse the frame." Abstract. The '247 patent also disclosed that " . . . centrally positioned along each of the four horizontal support arms 162 is a mid-span hinge 188 clearly shown in FIGS. 1, 3 and 4. Each of the four horizontal support arms 162 is circular and comprised of a lightweight material such as, for example, aluminum. The length of each of the four horizontal support arms 162 is interrupted approximately at the center of the span thereof forming two opposing, open-ended mid-span terminal ends 190 and 192 as shown in FIG. 3. Extending outward from each of the open-ended terminal ends 190 and 192 is a pair of connectors 194 and 196 having penetrations formed therethrough. Connectors 194 and 196 may be comprised of plastic having an outer surface which exhibits a low coefficient of friction such as Teflon. Positioned between the pair of connectors 194 and 196 is a pair of parallel positioned plates 198 and 200 swivelly attached to the corresponding connectors 194 and 196, respectively, of each of the horizontal support arms 162. The parallel positioned plates 198 and 200 are attached to each of the corresponding connectors 194 and 196 as by, for example, use of a pair of rivets 202 through the penetrations formed in the connectors 194 and 196 as is shown in FIG. 3. Mounted over each of the horizontal support arms 162 and the mid-span hinge 188 is a sliding sleeve 204 shown in FIGS. 1, 3 and 4. The sliding sleeve 204 is cylindrical in shape and can be comprised of aluminum or a high strength plastic material such as polyvinylchloride (PVC). Further, the sliding sleeve 204 can have an inner surface (not shown) coated with a low friction material such as Teflon to minimize resistance to sliding. In the view of FIG. 3, the sliding sleeve 204 is disengaged and the mid-span hinge 188 is exposed and capable of swivelling. Under these conditions, the mid-span hinge 188 is flexibly collapsible and cooperates with the telescopic legs 108 and the bottom slider 130 to enable the collapsible frame 100 to collapse into the reduced size posture as clearly shown in FIG. 9. Located on the surface of the horizontal support arm 162 is a first mechanical stop 206 as shown in FIG. 3. The first mechanical stop 206 serves to limit the travel of the sliding sleeve 204 away from the mid-span hinge 188." Col 7, line 47—Col. 8, line 11.

The '247 patent goes on to explain that " . . . each of the top support members 174 comprise two portions best shown in FIG. 6. An outer portion 220 is shown fitting over the end of an inner portion 222 at a lip 224. With this arrangement, the inner portion 222 can be separated from the outer portion 220 under pressure. Running the length through the interior of each of the top support members 174 is an elastic cord 226 as shown in FIG. 6. The elastic cord 226 can be connected on each of its ends to the interior of each of the top support members 174 in any suitable manner such as, for example, by tying. The function of the elastic cord 226 is to urge the mating of the outer portion 220 with the inner portion 222 of the top support member 174 while simultaneously enabling them to be separated. This design facilitates the collapsing of the superstructure 106 but also prevents the outer portion 220 from being separated from the inner portion 222." Col. 9, lines 7-22.

U.S. Pat. Nos. 5,797,412 and 5,632,293, each entitled COLLAPSIBLE SHELTER WITH FLEXIBLE, COLLAPSIBLE CANOPY, Aug. 25, 1998 and May 27, 1997 to Carter, disclose that " . . . the collapsible shelter includes a truss and canopy framework that permits a flexible, collapsible canopy to be moved between a raised position and a lowered position. The collapsible shelter includes at least three legs supporting flexible poles removably mounted to the tops of the legs and forming the framework of the canopy. X-shaped truss pairs of link members are connected to each of the legs on each side of the shelter between adjacent legs." Abstract. The '412 and '293 patents also disclose that "the present invention provides for a collapsible shelter with a flexible, collapsible canopy framework that can be raised to provide increased headroom, strength and stability, and can be lowered to provide a reduced profile to the wind. The invention provides for a collapsible shelter having at least three legs supporting a collapsible canopy supported by flexible poles removably mounted to the tops of the legs. At least two perimeter truss pairs of link members are connected to each of the legs on each side of the shelter between two adjacent legs. Each of the X-shaped perimeter truss pairs of link members are essentially identical, and include two link members connected together by a central pivot, with the first link member having an outer end connected to the upper end of one leg, and the second link member having an outer end slidably connected to the leg. The first and second link members are pivotally connected together in a scissors configuration so as to be extendable from a first collapsed position extending horizontally between two of the legs to a second extended position extending between the legs. The two perimeter truss pairs of link members on each side are connected together at their inner ends. The collapsible shelter preferably has four legs, but can also have three, five, or more legs. At least two flexible pole members are also provided that are removably mountable to the upper ends of the legs of the shelter to extend across the shelter to form a structure for a flexible, collapsible canopy. The canopy also preferably includes a cover secured to the upper ends of the legs. In a currently preferred embodiment of the invention, the flexible pole members comprise a plurality of segmented poles formed from a plurality of pole sections that are removably connectable together, and that are removably mounted in indexing holes in hinge means affixed to the upper ends of the legs, and the pole members are similarly removably connected together by a central hub that is preferably permanently connected to an inner end of one of the pole members. When the pole members are connected together and inserted in the hinge means of the legs, the pole members forming the canopy can flex and move between a normal raised position and a lowered position by exertion of a downward force on the top of the canopy, such as by a strong wind, to reduce the profile of the shelter that would be exposed to the wind and still provide rain run off. To facilitate this aspect of the invention the flexible poles in a currently preferred embodiment are made of a composite material such as fiberglass, but a variety of materials such as metal tubing and other composites can be used for such purposes. Col. 1, line 53—Col. 2, line 34.

The '412 and '293 patents go on to disclose that " . . . an the currently preferred embodiment, four flexible pole members 82 are provided, corresponding to the number of legs, as is illustrated in FIGS. 6, 7 and 12. While a variety of materials such as metal tubing, composite tubing (tubing made of resin impregnated fibers) or solid composite poles may be used, the flexible pole members currently preferably each comprise segmented flexible poles formed from two fiberglass pole sections 84 that are removably connectable together, with an inner end 86 of one of the pole sections bearing a metal jacket 88, made of aluminum or steel for example, into which the adjacent inner end 90 of the other pole section is insertable, to join the pole sections together. The pole sections are preferably hollow, and an elastic cord 92 runs through the longitudinal centers of the pole sections. An outer end 94 of the cord of each pole member extends through an indexing aperture 96 in the hinge means, and is secured to the hinge means such as by a knot. The inner end 98 of the cord is secured to the inner end 100 of the pole member, such as by a knot, so that the pole sections of the pole member are biased together. The pole members are removably receivable for mounting in the indexing apertures 96 in the hinge means affixed to the upper ends of the legs. In a currently preferred embodiment, a central hub member 102, having four symmetrically located indexing holes 104 for removably receiving the inner ends of three pole members, and for permanently receiving the inner end of a fourth pole member, mounted in a hub indexing hole, such as by an adhesive such as epoxy, for example, for joining the pole members together." Col 5, lines 14-38.

U.S. Pat. No. 4,074,682, entitled COLLAPSIBLE TENT FRAME, issued to Yoon on Feb. 21, 1978 discloses " . . . a collapsible tent frame has all of its parts permanently connected to one another to provide a complete single unit and is easily changeable between a fully deployed condition, a partially deployed condition and a compact collapsed condition by simple manual manipulations. In either its fully deployed condition or its partially deployed condition, the frame is adapted to receive and support a tent fabric or other covering to provide a shelter lending itself to a variety of uses." Abstract. The '682 patent also discloses that " . . . the frame is unitized insofar as all of its parts are permanently connected with one another and it is shiftable between a compact collapsed condition and at least one deployed condition." Col 1, line 67—Col. 2, line 2. In addition the disclosure of the '682 patent notes that " . . . a more specific aspect of the invention resides in each leg of the frame including an inboard section, an intermediate section and an outboard section with the outboard section being pivotally connected with the intermediate section for movement relative to the intermediate section between a folded condition and a spread condition. The intermediate section is also pivotally connected to the inboard section for pivotal movement between folded and spread conditions relative to the inboard section; and likewise, as previously mentioned, the inboard section is movable relative to the hub between deployed and collapsed positions. When all of the inboard sections are deployed relative to the hub and all of the intermediate sections are spread relative to the inboard sections, the outboard sections may be either spread relative to the intermediate sections to provide a fully deployed frame providing one form of structure, or the outboard sections may be folded relative to the intermediate sections to provide a partially deployed frame providing another form of structure. In either the fully deployed condition or the partially deployed condition of the frame, struts extending between adjacent pairs of legs aid in controlling the angular spacing of the legs and in thus rigidifying the frame, the struts each being made of two arms pivotally connected to one another and to their associated legs to permit collapsing of the frame." Col 2, lines 26-51. The specification of the '682 patent goes on to say that " . . . In the deployed condition of the frame, the arms 74, 74 of each strut are locked in their relatively aligned positions shown in FIGS. 2 and 16 by a suitable releasable locking means such as the sleeve 80 shown in FIGS. 13, 14 and 15. That is, in the aligned and locked arm situation of FIG. 13, the sleeve 80 fits over the joint between the two arms to prevent relative pivotal movement between such arms; but, the sleeve is slidable to the position of FIG. 15 at which the joint is freed to allow relative rotation between the arms. A spring 82 in the sleeve frictionally holds the sleeve to whatever position it is moved." Col 5, lines 32-41.

U.S. Pat. No. 5,930,971, entitled BUILDING CONSTRUCTION WITH TENSION SUPPORT SYSTEM, issued to Ethridge on Aug. 3, 1999 discloses " . . . a structural system for a building wherein multiple elongate rigid structural members, in the nature of posts and beams, include internal tensioning cables which, upon an end joining of the structural members, are interlocked and tensioned to each other and relative to a fixed foundation." Abstract. The specification of the '971 patent goes on to say that " . . . basically, the construction system utilizes a plurality of rigid, compression-accommodating structural members, preferably tubular, defining upright support posts, roof beams, cross beams, and the like. The rigid structural members are stabilized by elongate tension members, generically herein referred to as cables, received through each of the structural members and end joined, upon a proper tensioning thereof, at or immediately adjacent the adjoining ends of the structural members. The joined cables ultimately extend through uprights and are in turn anchored to an underlying foundation either in the nature of a solid cast concrete slab with anchoring loops extending therefrom, or individually cast footings associated with each upright." Col. 1, lines 40-53.

U.S. Pat. No. 6,028,570, entitled FOLDING PERIMETER TRUSS REFLECTOR, ISSUED TO Gilger et al. on Feb. 22, 2000 discloses a "collapsible support structures, fold-up perimeter trusses, principally for deployable high frequency parabolic antennas used in spacecraft." Col. 1, lines 5-7. U.S. Pat. No. 5,871,026, issued to Lin on Feb. 16, 1999, entitled UMBRELLA SHAPE TWO LAYERS FOLDABLE TENT, disclosed a "two layers half automatic foldable tent is comprised of a framework, an umbrella surface, and a tent cloth. The framework is enclosed on the outside of the tent, while the umbrella surface is expanded on the framework above the tent cloth, wherein the framework is presented as an expanding structure. The opening and closing of the umbrella frame is completed by a controlling rope. Any user may easily install the tent, the lower primary frame of the umbrella frame may be folded upwards as the framework is closed, thus it may be stored conveniently and may be carried. Another, since in the present invention, the umbrella surface and tent cloth are designed as the two layers type thus the sunlight, rain water and snow will not contact the tent directly, and the people within the tent will be safe and comfortable and the lifetime of a tent is prolonged." Abstract.

U.S. Pat. No. 4,998,552, entitled GEODETIC TENT STRUCTURE, issued to Niksic et al on Mar. 12, 1991, discloses a "self supporting collapsible tent structure having a tension bearing polygonal shaped floor member defining a first tent level, a plurality of hub members each carrying a plurality of sockets which are pivotal about axes which are co-planer and are interrelated one to the other as the sides of polygon, a series of said hub members disposed in a plane at a second tent level which is spaced apart from said first tent level and whose sockets are pivotal in a first direction, and additional series of said hub members disposed in a plane at a third tent level which is spaced apart from said second tent level and whose sockets are pivotal in a second direction, opposite to the said first direction, a single, apex forming hub member disposed at a fourth tent level and whose sockets are pivotal in said first direction, a first plurality of compression rods, the ends of which are seated in the said sockets of the hub members in slightly curved polygonal planes defined and bounded by the rod members and a second plurality of compression rods, one end of which are seated in sockets of the hub members at the second tent level and the other end of which are connected to the perimeter of the floor member." abstract.

U.S. Pat. No. 4,583,956, issued to Nelson on Apr. 22, 1986, entitled RIGID AND TELESCOPING STRUT MEMBERS CONNECTED BY FLEXIBLE TENDONS, discloses a "construction kit consisting of rigid or telescoping elongate strut members which may be attached together by flexible tendons to form a variety of designs and model structures. The invention places no limits on the number of struts which can be attached at one vertex or their relative angles, and the length of each strut may be varied within broad limits. Furthermore, the end of one strut may be attached not only to the end of another, but to any point along its length. Accordingly, an almost unlimited variety of constructions is possible." Abstract.

U.S. Pat. No. 4,438,876 discloses a "back pack frame is comprised of tubular frame members which upon separation permit extraction of pairs of tent frame components stowed therein. The frame members and tent frame components are thereafter rejoinable to provide a geodesic tent frame. The tent frame components, upon extraction from a stowed position within the back pack frame members, are positioned in a divergent manner as permitted by a wire hinge component interconnecting the paired tent frame components. The back pack frame members are slotted at their ends to permit such divergent positioning of the associated tent frame components and include limit stops to prevent complete separation of the tent frame components from their frame member. The back pack frame members themselves are coupled to one another by flexible wire inserts and, in a modified form, by molded socket members. A back pack bag may be supported either externally on the back pack frame or, alternatively, over frame members." Abstract. The disclosures of the above referenced prior art are hereby incorporated by reference.

None of the foregoing discloses or suggests solutions to the problems with the foregoing which do not fully satisfy the needs for s compact, light weight, fully portable and exceptionally strong, once assembled, collapsible support structure. The present invention satisfies those needs more effectively than the above described prior art.

SUMMARY OF THE INVENTION

A method and apparatus is described for providing a collapsible support structure, which may comprise a plurality of interconnected frame sections each of which may comprise a first elongated rigid member having a first end and a second end; a second elongated rigid member having a first end and a second end; wherein the first end of the first elongated rigid member and the second elongated rigid member are hingedly joined; a collapsible elongated member which may comprise an elongated flexible tensioning member connected between the second end of the of the first elongated rigid member and the second end of the second elongated rigid member; a first hollow tubular rigidizing member extending along a portion of the length of the elongated flexible tensioning member; a second hollow tubular rigidizing member extending along essentially the remainder of the length of the elongated flexible tensioning member; and a rigidizing sleeve member slideably mounted on the first or the second hollow tubular member and sized to slideably engage the other of the first and second hollow tubular when the first and second hollow tubular rigidizing members are essentially axially aligned and the rigidizing sleeve member is positioned to slideably engage each of the hollow tubular rigidizing members to form a collapsible elongated tubular member extending essentially between the second ends of each of the first and second elongated rigid members and having the elongated flexible tensioning member axially disposed therein. The apparatus and method may employ the interconnected frame sections on the form of a triangle or a parallelogram, and may form a portion of a geodesic structure, such as a truncated icosahedron, which in turn may have first and second lesser circle polygonal shapes, with the hingedly joined first ends of the first and second elongated rigid members being joined at a corner of the first lesser circle polygonal shape and the collapsible elongated tubular member forming a side of the second lesser circle polygonal shape. The method and apparatus may use one-piece elongated rigid members. The sections may form parallelograms using first, second and third elongated rigid members and first and second rigidizing means, with each of the rigidizing means in each section forming a side of a separate one of the lesser circle polygonal shapes.

DETAILED DESCRIPTION OF THE PREFERRED EMBODIMENTS

Figure 1:
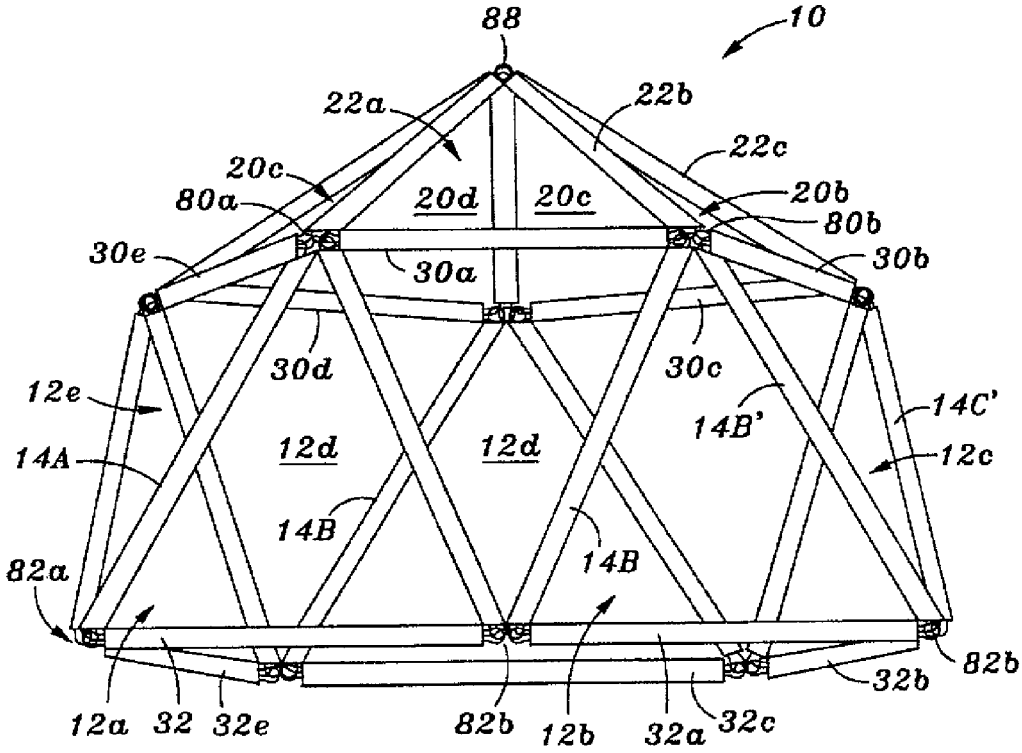
FIG. 1 shows a basic structure for a collapsible support structure frame according to an embodiment of the present invention.

Turning now to FIG. 1 there is shown a basic structure for a collapsible support structure frame 10 according to an embodiment of the present invention. The structure 10 may be a truncated icosahedron geodesic structure. Geodesic domes are sliced from a complex polyhedra which has a large number of triangular faces, all approximately, but not quite, equilateral. See. Kenner, Geodesic Math and How to Use It, University of California Press Berkeley, 1976, Chapter 7, the disclosure of the entire volume of which is hereby incorporated by reference. In the structure of the present inventions, however, the triangular faces on the side walls of the structure may be equilateral. The struts bounding the triangular faces in a geodesic dome may follow the paths of great circles that are concentric with the center of the domed structure, some whole, but more often interrupted. The cohesion of the whole, like that of a Tensegrity, is both compressive and tensile, with the tension system running along the outer surfaces of the struts, which are at the same time in compression. The structure 10 as shown may include a plurality of generally vertical sections 12 *a, b, c, d* and *e*. Each of the sections 12 *a, b, c, d* and *e* may include a first elongated rigid member 14*a*, a second elongated rigid member 14 *b* and a third elongated rigid member 14*c* where the third elongated rigid member 14*c* may also comprise the first elongated rigid member in an adjoining section 12*b*, which may also contain a second elongated rigid member 14*b*' and a third elongated rigid member 14*c*'. Each of the sections 12*a, b, c, d* and *e* may have an upper collapsible member 30 *a, b, c, d* and *e* and a lower collapsible member 32 *a, b, c, d* and *e*, more fully described below. Each of the sections 12 *a, b, c, d* and *e* may have a roof section 20*a, b, c, d* and *e*, which may be comprised of a first roof rigid member 22 *a* and a second roof rigid member 22*b*, where the second roof rigid member 22*b* may be the first roof rigid member in the adjoining roof section 20*b* which can also include a second roof rigid member 22*c*. It can bee seen that each of the sections 12*a, b, c, d* and *e* form the essentially vertical side walls of the structure with the collapsible members 30 *a, b, c, d* and *e* and the collapsible members 32*a, b, c, d* and *e* forming the sides of a pentagon polygon. The collapsible sections 32*a, b, c, d* and *e* can form the base of the collapsible support structure 10 and the collapsible members 30*a, b, c, d* and *e* may form the top of the essentially vertical side walls of the support structure 10 formed by the adjoining sections 12*a, b, c, d* and *e*.

Figure 2:
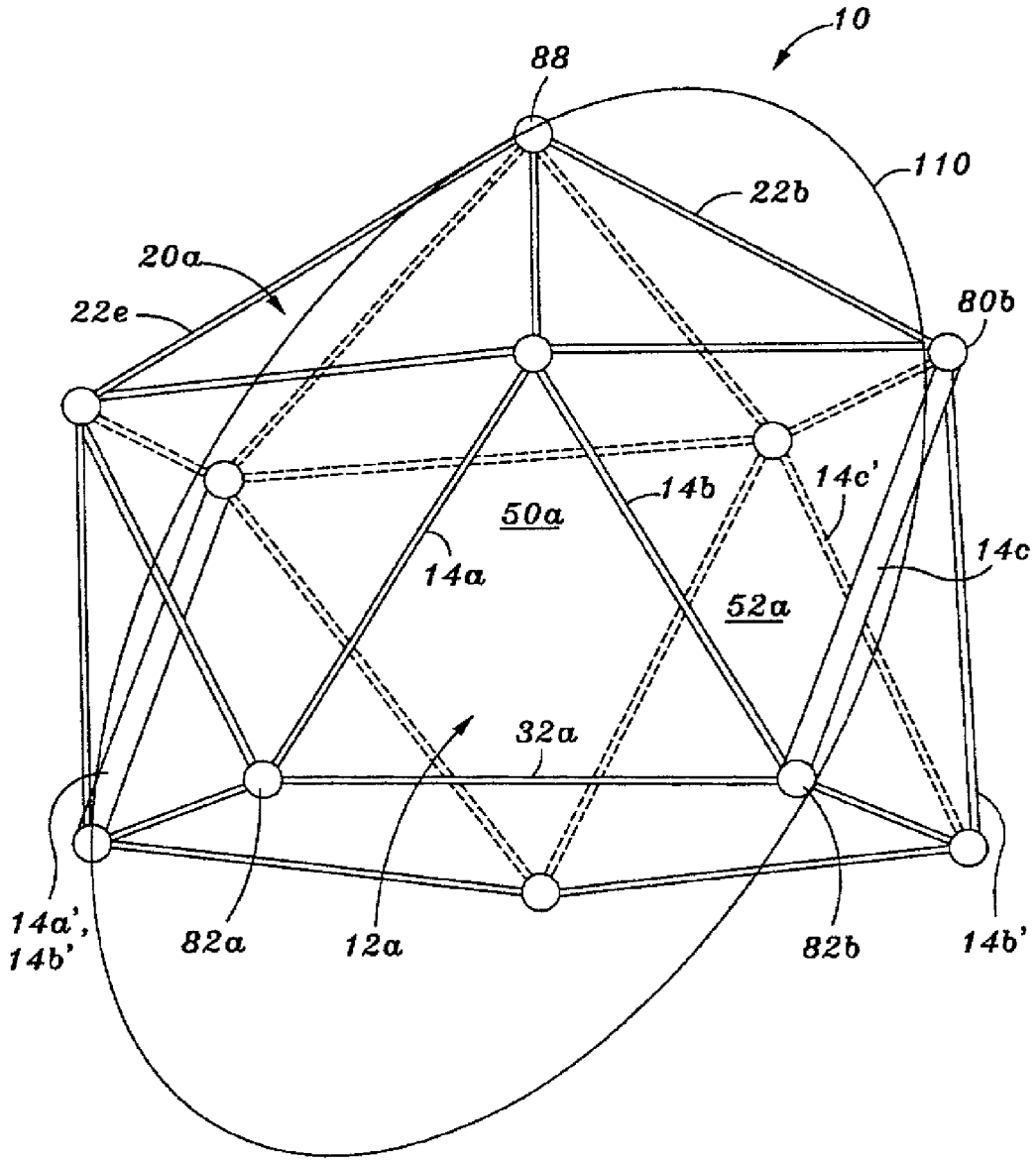
FIG. 2 shows schematically the geodesic structural relationship of opposing vertical members in a level of a geodesic structure according to an embodiment of the present invention.
Figure 3:
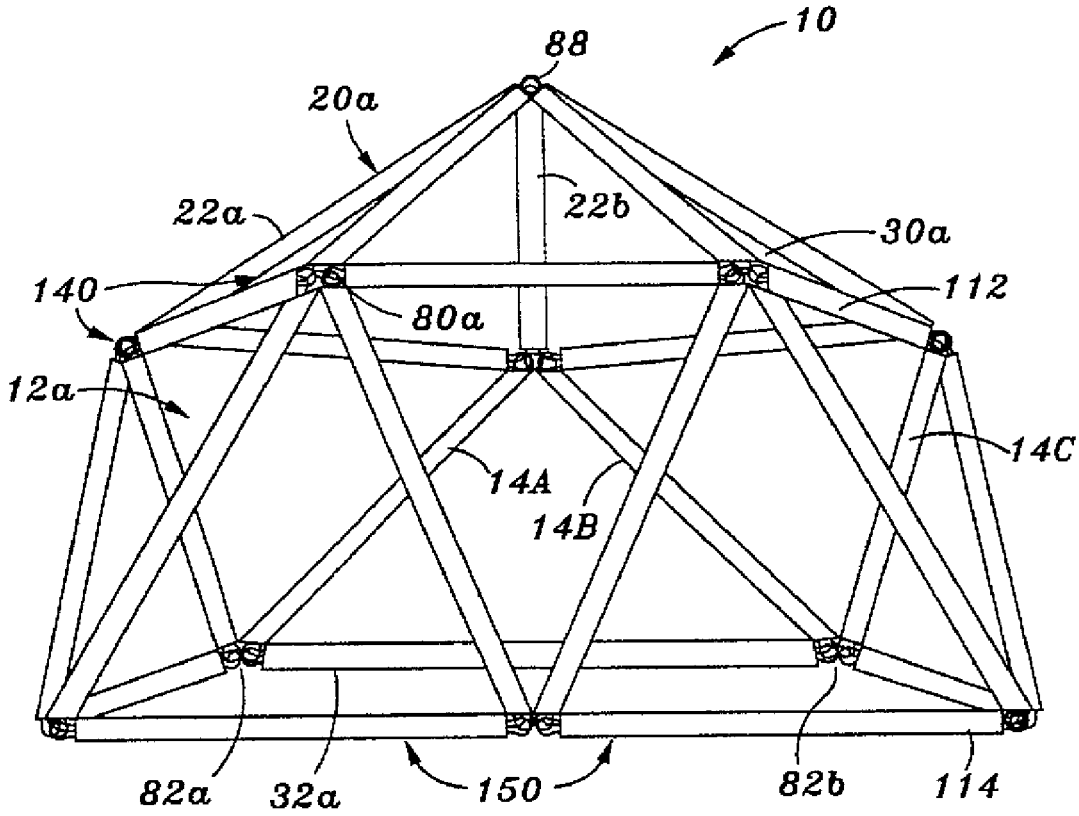
FIG. 3 shows a geodesic structural relationship of portions of the structure according to the embodiment of the present invention shown in FIGS. 1 and 2 in relation to lesser circles circumscribing the structure in horizontal planes at certain levels of the structure, FIGS. 4(*a*) and 4(*b*) show in more detail a rigidizing means according to an embodiment of the present invention.

As shown in FIG. 2, a characteristic of a geodesic structural form such as the icosahedron of FIGS. 1-3 is that the respective upper and lower ends of the opposing vertical sides rigid members, e.g., 14*c* and 14*b*''' form equivalent opposing arcs of a greater circle concentric with the geometric center of the structure 10 if it were not truncated to form the base with the collapsible members 32*a, b, c, d* and *e*, i.e., if it had a structure equivalent to the roof structure attached to the base members 32*a, b, c, d* and *e* in the nature of a complete icosahedron.

Turning now to FIG. 3 there is shown another characteristic of a truncated icosahedron 10 according to such structures as employed in accordance with the present invention. Each of the upper and lower collapsible members, respectively 30*a, b, c, d* and *e* and 32*a, b, c, d* and *e* for the sides of a pentagon which is circumscribed by a lesser circle in the plane of the pentagon and intersected by the corners of the pentagons it will also be appreciated by those skilled in the art that the respective pentagons formed by the collapsible members 30*a, b, c, d* and *e* and 32*a, b, c, d* and *e* may be of the same size or of a different size, and in the latter event, the vertical walls of the structure as shown in FIGS. 1-3 could slant slightly inwardly or slightly outwardly toward the top portion of the wall formed by the collapsible members 30*a, b, c, d* and *e*, accordingly. In the truncated icosahedron 10 at six points along the top of the vertical walls formed by the sections 12*a, b, c, d* and *e* five triangles meet at each vertex, e.g., 80*a* or 80*b* shown in FIGS. 1-3. At the vertexes along the base formed by the collapsible members 32*a, b, c, d* and *e*, only three triangles meet at each vertex. Each of the five vertices of five intersecting triangles in a geodesic structure is called a pent after the pentagons that surround them. From each of the pents radiate portions of five great circles each of which has its center at the geometric center of the structure, were it a full icosahedron as opposed to a truncated one as shown. Each of the great circles sets of about 63.5° before intersecting the opposite end of the rigid structural member, e.g., 14 *c* or 14 *b*''' as shown in FIG. 2, radiating from the pent, generally in the plane of the great circle. Following the lead of either of the pentagon edges forming the base or the top of the vertical walls formed by sections 12*a, b, c, d* and *e* one may trace a circuit around the geodesic sphere forming a lesser circle with its center at the center of the pentagram, girdling the sphere in generally parallel planes, e.g., like the trop latitudes on the globe of the earth. In the pure geodesic dome, the struts forming the arcs of the lesser circles are almost, but not quite coplanar. Of course, the vertically extending struts can be adjusted as necessary and desired to correct this lack of co-planarity. Truncated dome design of the present invention is completed by placing the base formed by the collapsible members 32*a, b, c, d* and *e* on the ground with the collapsible members 32*a, b, c, d* and *e* and 30*a, b, c, d* and *e* in the rigidized configuration.

Figure 4A:
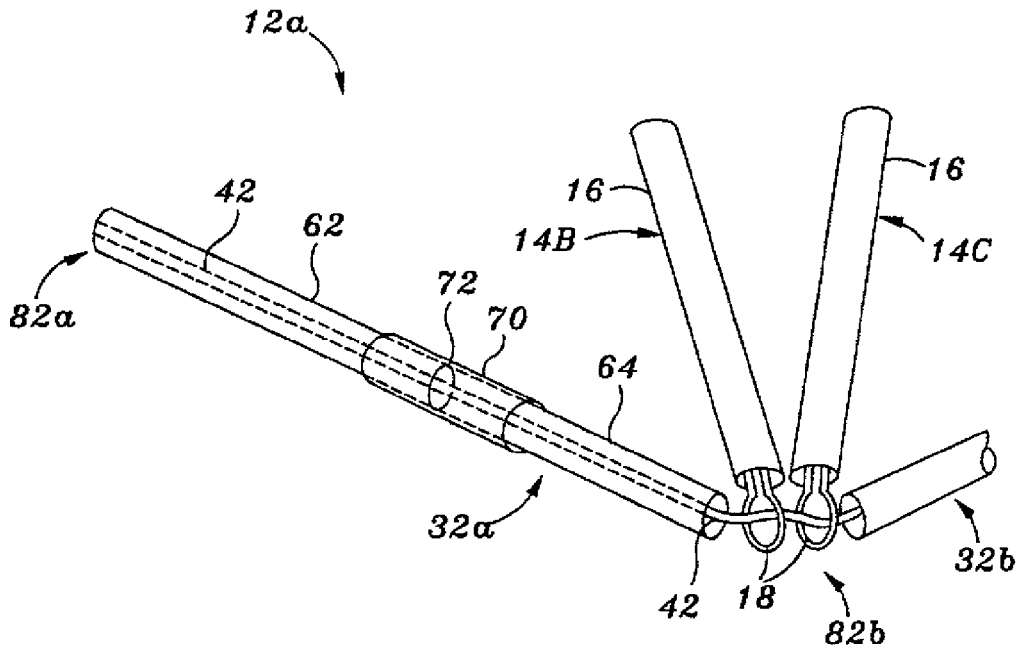
Figure 4B:
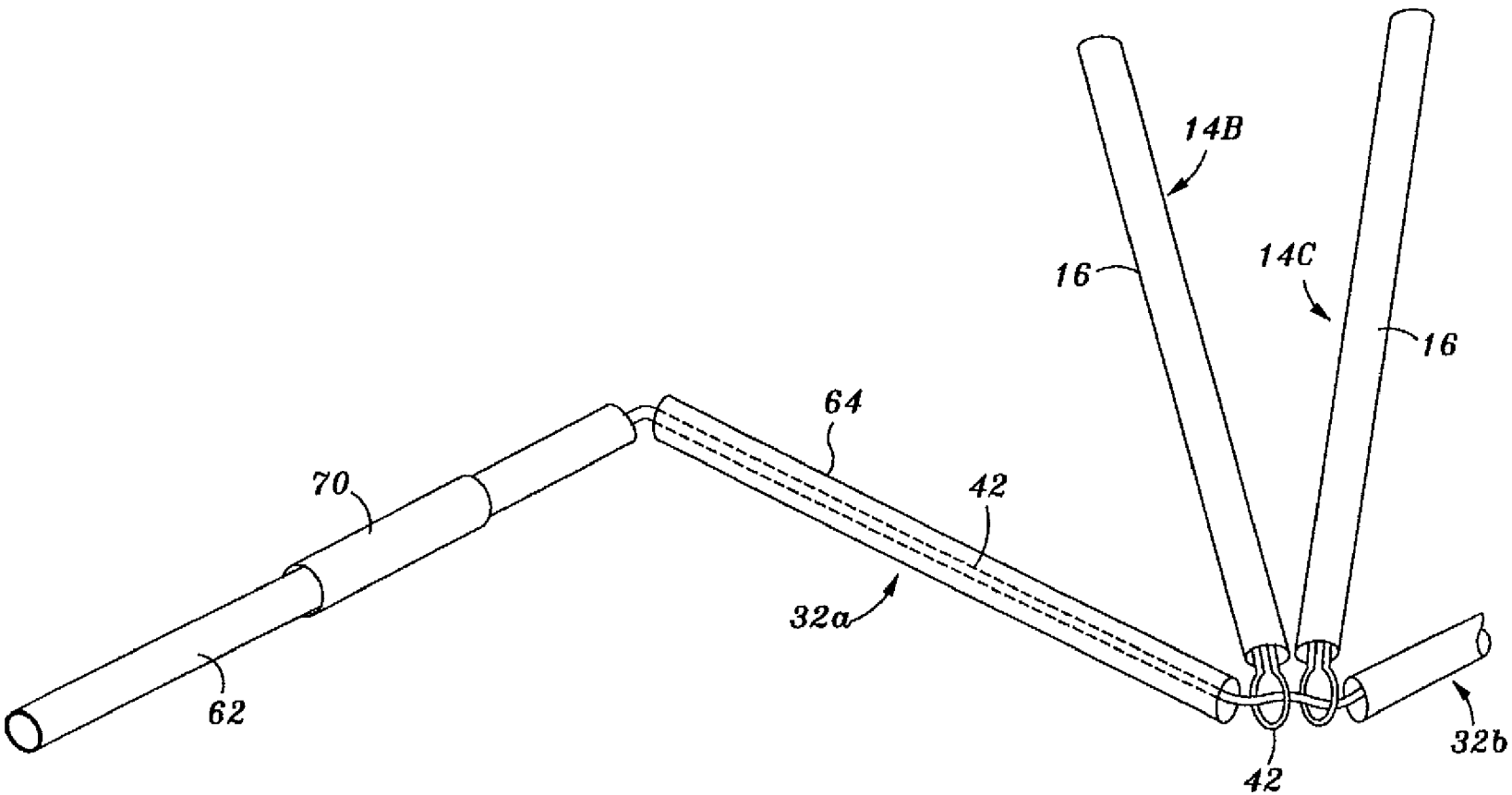

Turning now to FIG. 4(*a*) the apex 82*b* of the section 12*a* of the vertical walls of the structure 10 is shown in more detail to explain the interrelationship between the rigid members 14 *a, b* and *c*, and the collapsible members 30*a* and by example 30*b* forming the section 12*a*. Each of the elongated rigid members 14*a, b*, and *c* may consist of an elongated wooden dowel 16. Each of the elongated rigid dowels 16 may have attached to either end thereof an eyelet, e.g., a screw-in eyelet 18. An upper flexible circumferential tensional support member, e.g., a length of rope (not shown) may extend through the eyelets 18 on the upper ends of the dowels 16 (not shown)—forming the elongated rigid structural members 14*a* and 14*b*, which may be positioned adjacent to each other forming an upright triangular portion 50*a* (FIG. 2) of the section 12*a* along with the lower collapsible member 32*a*. A lower flexible tensional circumferential support member, e.g., a length of rope 42 or cable, may extend through the lower collapsible support member 32*a* (shown in phantom by dotted/dashed lines) and through the pair of eyelets 18 on the lower ends of the dowels 16 forming the elongated rigid members 14*b* and 14*c*. Similarly the upper length of rope (not shown) extends through the upper collapsible member 30*a* between the joined ends of the elongated rigid structural members 14*a* and 14*b* and the upper end of the elongated rigid structural member 14*c*, and the lower length of rope 42 extends between the eyelets 18 on the lower ends of the elongated rigid structural members 14*b* and 14*c* that are joined together thereby, such that the elongated rigid structural members 14*b* and 14*c* along with the upper collapsible member 30*a* form an inverted triangular portion 52*a* (FIG. 2) of the section 12*a*. Thus it can be seen that the section 12*a* can be in the form of a parallelogram, with the corners of the parallelogram formed by upper junctions 80*a* and *b* and the lower junctions 82*a* and *b*, with the upper collapsible member between 80*a* and *b* forming the base of the inverted triangular portion 52*a* and the lower collapsible member 32*a* forming the base of the upright triangular portion 50*a* of the section 12*a*.

In the embodiment shown in FIG. 4(*a*) it can be seen that the collapsible member 30*a* and 32*a* (not shown in FIG. 4) may be formed by a pair of hollow cylindrical tubes 62 and 64 and an outer tubular sleeve 70. In the embodiment shown in FIG. 4 the pair of tubes 62, 64 extend substantially the length of the base of the respective upright and inverted triangular portions 50*a* and 52*a* and the outer sleeve 70 slideably engages both the tube 60 and the tube 62 when the respective upper or lower collapsible member, e.g., lower collapsible member 32*a* is in the rigidized configuration. The abutment of the tubes 60 and 62 at junction 72 is illustrated in FIG. 4(*a*). This abutment serves to hold the rigidized collapsible member 32*a* in compression when the tensile forces exerted, e.g., by tightening the rope 42 around the lesser circle traveled by the rope 42 (along with the similar action of the upper rope (not shown) gives the structure 10 its structural rigidity.

Turning now to FIG. 4(*b*) it can be seen that the outer sleeve 70 is of a length that it can be slideably moved to enclose only the one or the other of the two tubes 60, 62, such that the rigidity provided by the sleeve 70 engaging both the tubes 60 and 62 is eliminated. This enables the respective ends of the elongated rigid structural members, e.g., 14*a, b* and *c*, the former two of which were maintained in separation by the collapsible member 32*a* being rigidized, to move toward each other, enabling collapsing and folding of the structure 10, when done in conjunction with similarly removing the rigidity of each of the collapsible members 30*a, b, c, d* and *e* and 32*a, b, c, d* and *e*.

Figure 5:
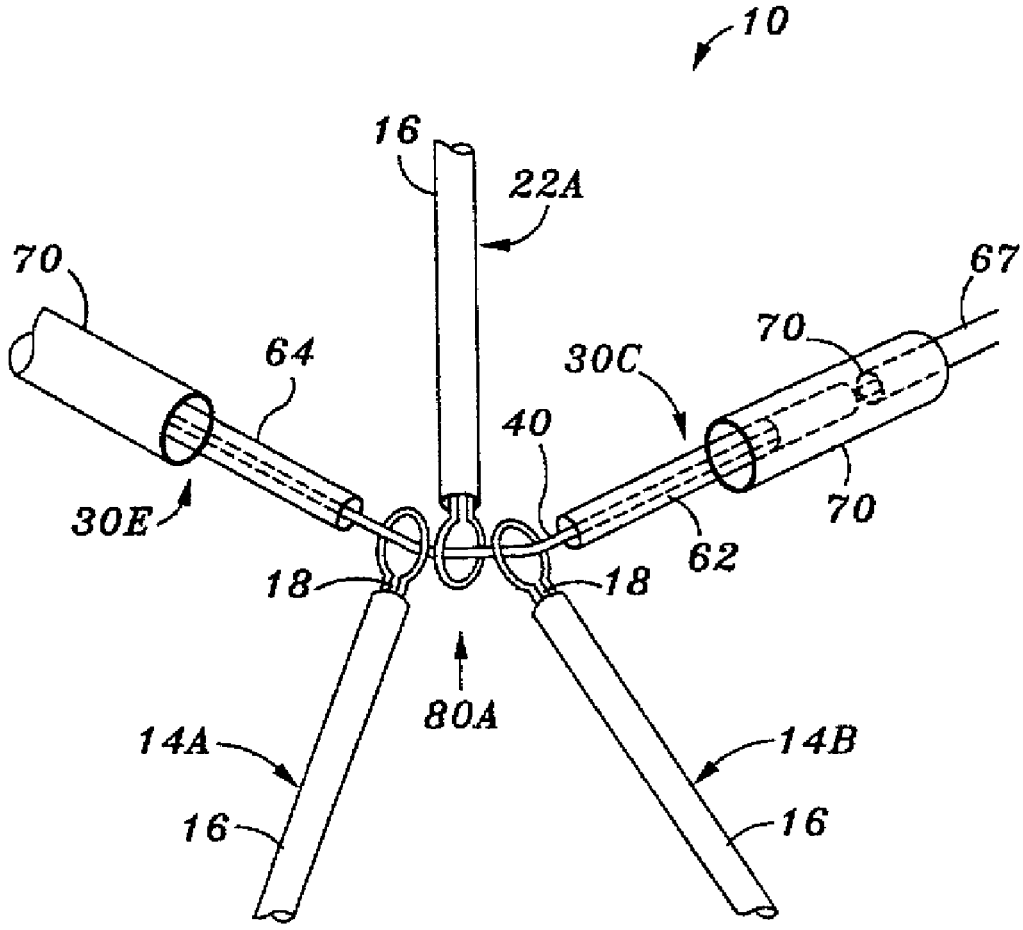
FIG. 5 is a more detailed view of an embodiment of an upper terminal junction according to the present invention.
Figure 6:
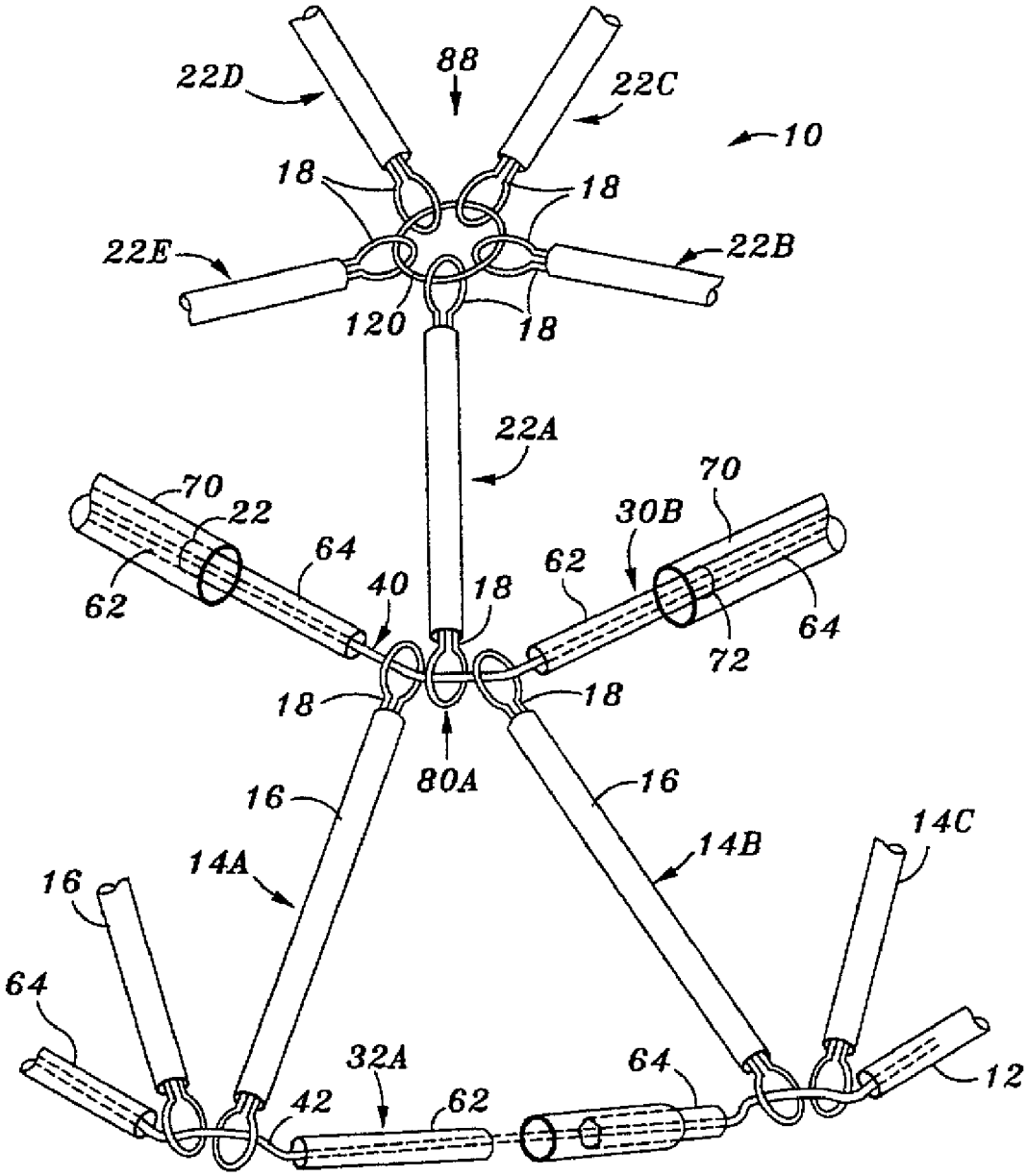
FIG. 6 is a perspective view of a portion of the present invention showing an entire vertical section from the ground to the apex of an embodiment of a collaplible support structure according to the present invention.

Turning now to FIG. 5 there is shown a more detailed view of an embodiment of an upper terminal junction or apex 80(*a*) according to the present invention. The eyelets 18 for each of the dowels 16 forming vertical poles 14*a* and 14*b* and roof pole 22*a* are joined by having the rope of cable 40 forming the upper flexible circumferential support member threaded through them and passing through the adjacent hollow tubes 64 of the upper collapsible member 30*e* and 62 of the upper collapsible member 30*a*, with the vertical poles 14*a* and 14*b* forming a triangular portion of section 12*a* and roof pole 22*a* extending to the top of the structure 10. This is shown in further detail in FIG. 6. Turning to FIG. 6 there is shown a perspective view of a portion of the collapsible structure 10 according to the present invention showing an entire vertical section from the ground to the apex of the embodiment 10. FIG. 6 shows that the roof poles 22*a, b, c, d* and *e* are joined at the top apex of the structure, e.g., by an apex ring 120. The apex ring may be, e.g., s ring that has a hinged opening allowing the ring to be inserted through the eyelets 18 and the upper ends of each of the roof poles 22*a, b, c, d* and *e*.

Alternatively the apex ring 120 may simply be a piece of rope or cable threaded through the eyelet 18 openings.

Figure 7:
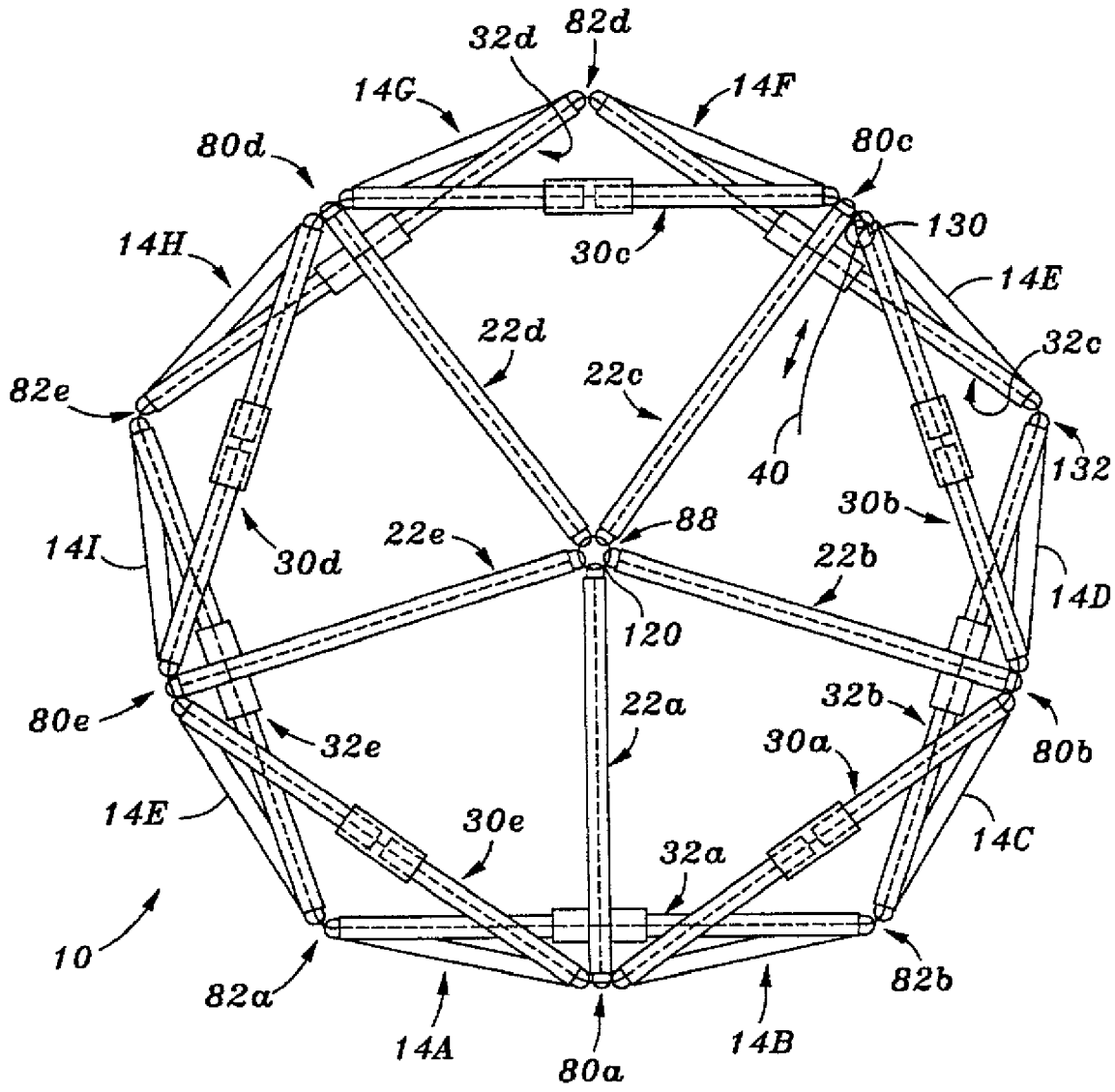
FIG. 7 is a plan view of an embodiment of a collapsible support structure according to the present invention in its erected state.

Turning now to FIG. 7 there is shown a plan view of an embodiment of a collapsible support structure 10 according to the present invention in its erected state.

Figure 8:
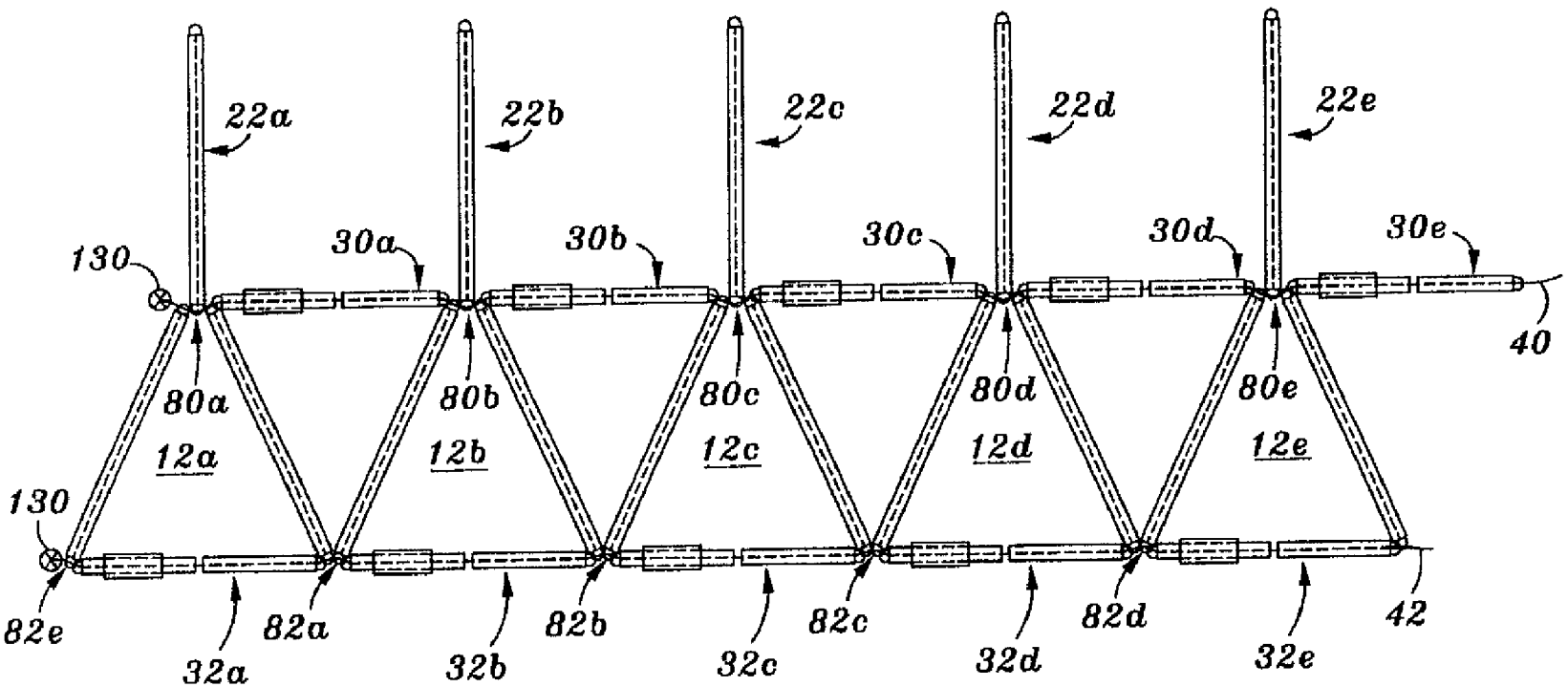
FIG. 8 shows a partially cut away side view of an embodiment of a collapsible support structure according to the present invention in an intermediate stage of being collapsed and stored.

Turning now to FIG. 8 there is shown a partially cut away side view of an embodiment of a collapsible support structure according to the present invention in an intermediate stage of being collapsed and stored. In this view one section containing portions bottom collapsible support members 32*b* and 32*c* and upper horizontal collapsible support members 30*b* and 30*c* are omitted. In the view of FIG. 8, there are shown a pair of anchor rings 130. The anchor rings 130 may be in the form of a circular ring containing crossed members. The anchor rings 130 are constructed so as to easily connect one end of an upper horizontal flexible circumferential support 40 or lower horizontal flexible circumferential support 42, e.g., a cable or rope, to the anchor ring, as by tying, welding, crimp locking or the like, and such that the anchor ring will not pass into the adjacent hollow tube 62 or 64, as the case may be. It will also be understood that the anchor ring 130, on the lower circumferential support 42, except for necessary tightening due to loosening or shifting over time in use, may be essentially permanently affixed to the other end of the lower circumferential support 42, whereas, unless the roof struts 22*a-e* are constructed to enable, e.g., telescoping, the anchor ring 130 on the upper circumferential support may need to be undone each time to enable the roof struts 22*a-e* to extend toward an apex position from the storage collapsed position due to their rigid length and the circumference of the upper circumferential support 40 in its tightened position.

As shown in FIG. 8 the sections 12*a, b, c, d* and *e* are laid out with the anchor rings tight against the apexes 82*a* and 80*a* respectively and with the upper and lower horizontal flexible circumferential support cable or ropes 40 and 42 extending out of one half of the apex 82*e* and out of the apex 80*e*, and through upper collapsible structural support member 30*e*.

Figure 9:
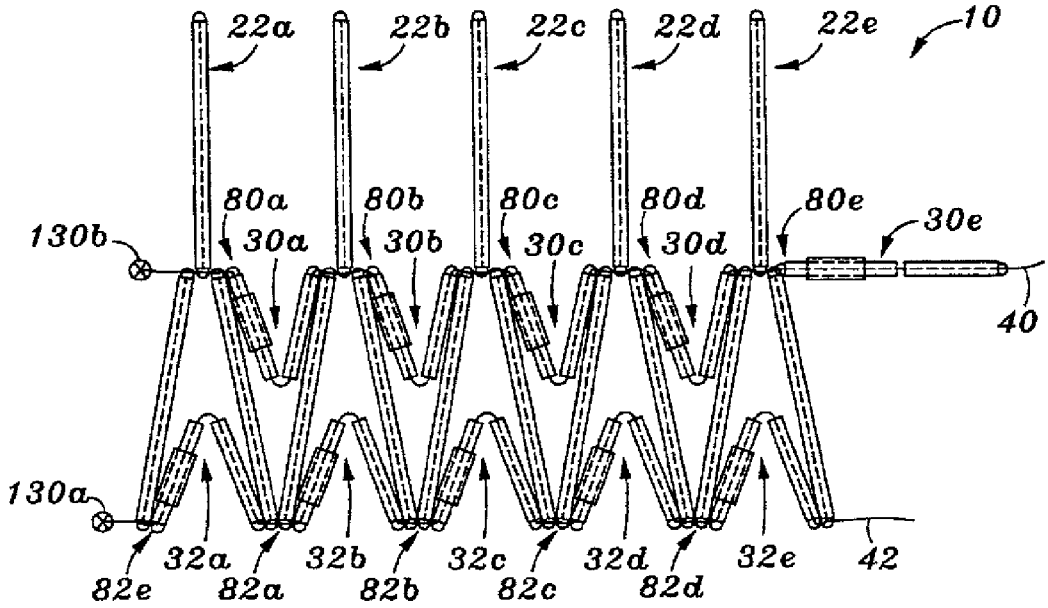
FIG. 9 shows a side view of the embodiment of FIG. 8 in the next succeeding stage of being collapsed and stored.
Figure 9A:
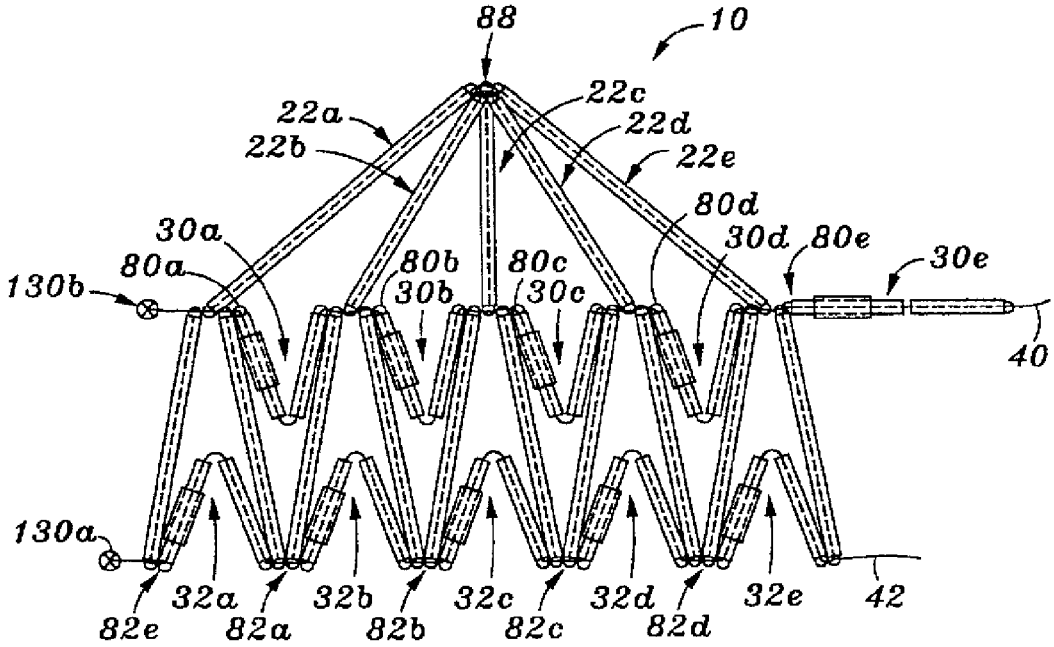
Figure 10B:
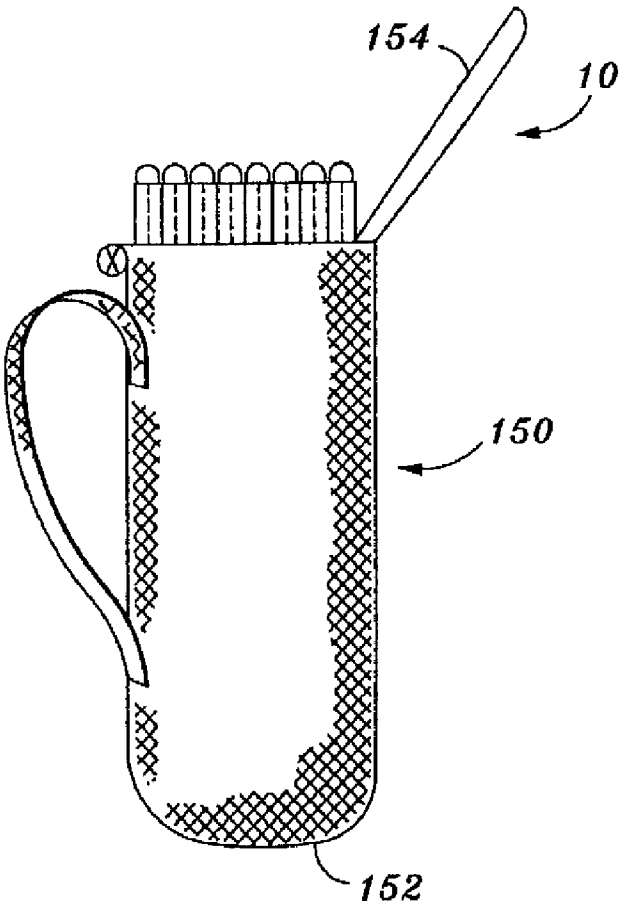
FIG. 10(*a*) shows the embodiment of FIGS. 8 and 9 in a final stage of being collapsed for storage and FIG. 10(*b*) shows the stage of being placed into a storage bag.
Figure 10A:
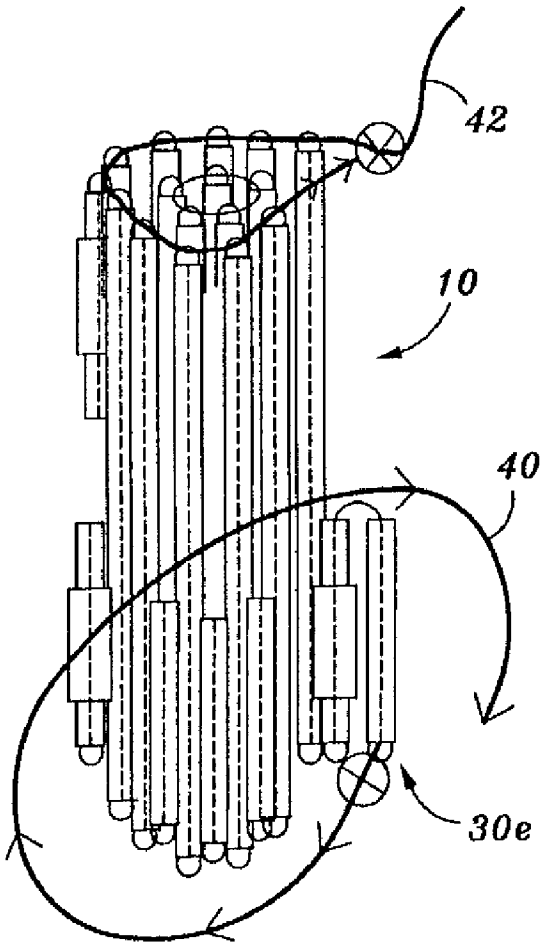

Turning now to FIG. 9 there is shown the initial stage of folding the collapsible horizontal support members between the respective adjacent vertical poles. The roof posts 22 *a, b, c, de* and *e* are then folded downwardly to the inside of the collapsed structure as shown in FIG. 10(*a*), with the lower horizontal flexible support member 42 pulled to tighten the bundle, and with the portion of the upper horizontal flexible support structure wrapped around the upper portion of the collapsed bundle to further tighten the collapsed bundle prior to insertion of the bundle into the storage bag as Shown in FIG. 10(*b*). It will be understood that the folding operation discussed in this paragraph can occur both with the apex ring in place (not shown) or not in place as shown.

Figure 11:
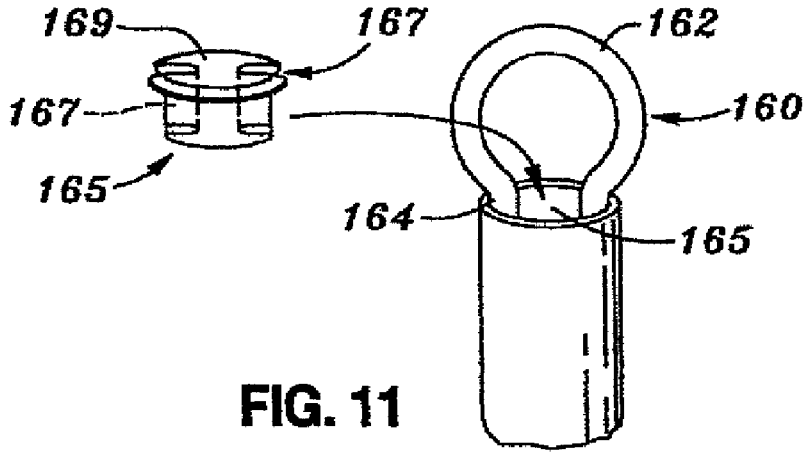
FIGS. 11, 12 and 13 show alternative possible improved embodiments for the eyelet joiners shown in earlier illustrated embodiments according to the present invention.
Figure 12:
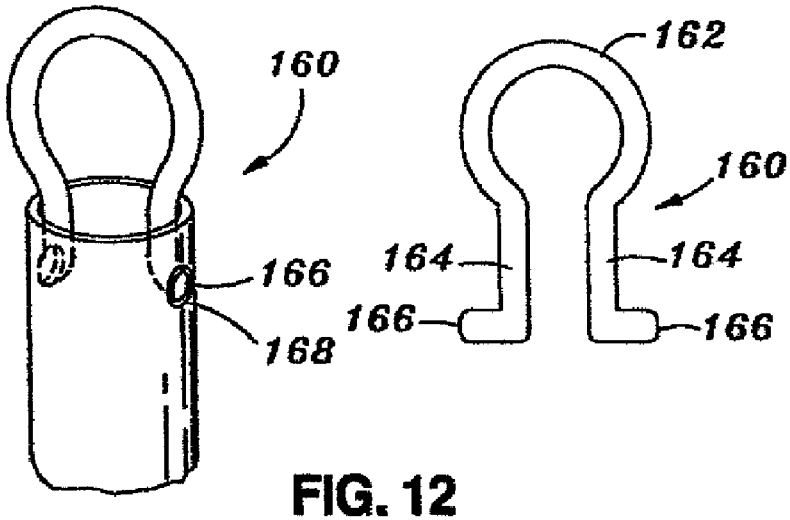
Figure 13:
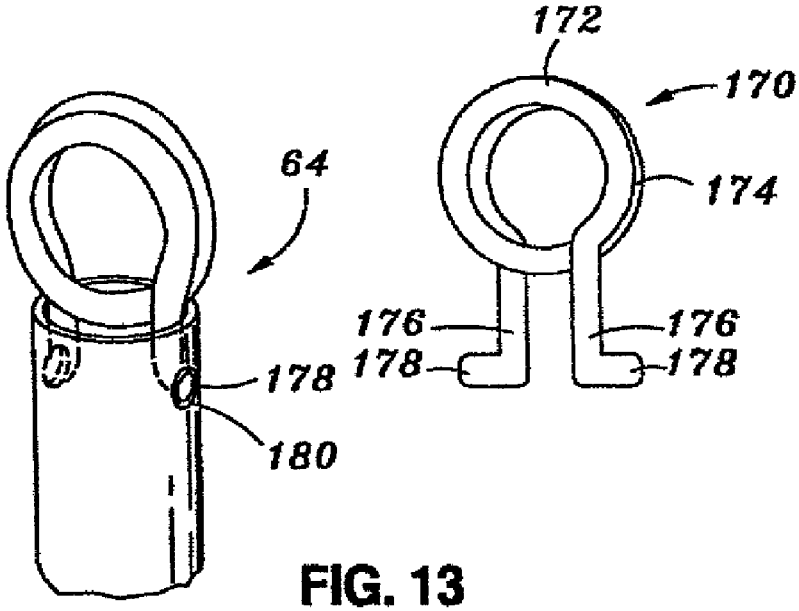

FIGS. 11, 12 and 13 show alternative possible improved embodiments for the eyelet joiners shown in earlier illustrated embodiments according to the present invention. In FIG. 11 and FIG. 12 there is shown one version of a pop-in connector 160, which consists of a loop 162 and a pair of straight leg portions 164, along with a protrusion 166 at the terminal end of the straight leg portion 164. In the embodiment shown in FIG. 11 the loop 162 can used in conjunction with a locking insert 165. The locking insert 165 is constructed to have a diameter along at least one axis that allows the structure, which may be constructed of a rigid though partially flexible material such as nylon, so as to fit snuggly within the end of a hollow tube. In the case of FIG. 11 the hollow tube is shown to have replaced the wooden dowels 16 as, e.g., the vertical structural members. In operation the pop-in connector of FIG. 11 is constructed to have a spring-like mode of operation with the protrusions biased to press against the inner surface of the hollow tube 16. Insertion into the grooves 167 of the locking insert 165, the protrusions are forced even more toward engagement with the inner surface of the hollow tube 16. In addition, depending upon the direction of the spring action of the leg portions, they may be biased against the surface of the respective groove 167 to further frictionally hold the pop-in connector 160. In the embodiment of FIG. 12, the hollow tube has a pair of opposing holes 168 and in this case the legs 164 of the loop 162 of the pop-in connector 160 are springedly biased outwardly so as to engage the protrusions 166 in the holes 168 to hold the pop-in connector in place.

As shown it can be seen that the pop-in connectors 160 can be of great use, e.g., if a pole/strut, e.g., 14 or 16 were to break while the structure is erect. Without having to essentially disassemble the structure frame 10 by unthreading the entire, e.g., upper flexible circumferential support 40 or lower flexible circumferential support 42 to rethread it through an eyelet such as the eyelets 18 discussed above, the pop-in connector can be used to selectively engage one of the supports 40, 42 at the respective end of a pole/strut at only the specific location of the pole/strut being replaced.

One possible disadvantage of the pop-in connector 160 described above is that over time the flexible support 40, 42, if it is made of fiber as opposed to being a metal cable, could fray on the ends of the tubular pole/strut. alternatively, the metal capable used as a flexible support 40 or 42 may wear down the tubular ends of the pole/strut. To prevent either of these, at the loss of flexibility in replacing poles/struts while the structure is erected, a pop-in connector such as the pop-in connector 170 shown in FIG. 13 may be employed. The pop-in connector of FIG. 13 has two loops, keeping the flexible circumferential support 40, 42 away from the tubular end of the respective pole/strut.

It will be understood that the tensioning means at, e.g., the base and the top of the vertical side walls of the structure 10 may be formed by rope or cable or the like and may be brought into tension simply by pulling on the rope or cable at a vertex, e.g. 80*b* and similarly, e.g., 82*b*, with the rope or cable attached, e.g., to an eyelet 18 on one of the dowels 18 forming part of the vertex, and looped through the other eyelet at the vertex, such that the tensioning rope or cable exerts tension between each of the vertices, while the collapsible members 30*a, b, c, d* and *e*, or 32*a, b, c, d* and *e*, as applicable, are placed in compression. It will also be understood that the compactability of the structure 10 of the present invention may be increased, and the height of the vertical walls formed by the sections 12*a, b, c, d* and *e* maintained by making the rigid members, e.g., 14*a, b* and *c*, themselves collapsible, e.g., by forming them of a two piece hinged construction as is known in the art for such supporting struts for collapsible structures and frames. In addition, the height of the vertical walls may be increased by adding a third or a fourth or more set of sections defined by another pair of adjacent lesser circle pentagons connected by rigid struts, e.g., in the triangular pattern as shown in FIGS. 1-3. It will also be understood that the roof struts 22*a, b, c, d* and *e* must be joined at the apex 88 of the structure 10 shown in FIGS. 1-3, which may be accomplished by simply as looping a rope through eyelets 18 at the terminal ends of the roof struts 22*a, b, c, d* and *e* meeting at the apex 88, or by any of the well known mechanical structures for forming such a roof apex in collapsible structure frames known in the art. It will be understood, however, that the making of this vertex at the apex 88 of the structure will ordinarily need to be formed before vertical side walls of the structure 10 are rigidized and will ordinarily need to be broken down before the structure 10 is collapsed, since the length of the roof struts 22*a, b, c, d* and *e* will prevent the apex 88 from collapsing through the plane of the lesser circle formed by the top of the vertical wall, i.e., by collapsible sections 30*a, b, c, d* and *e*, as shown in FIGS. 1-3 while remaining joined in abutted ends at the apex 88.

The collapsible support structure of the present invention provides a number of advantages beyond simply being collapsible and storable in a relatively compact form in a storage bag and being relatively easy to assemble and rigidize and collapse and store. No ropes or tie downs are needed to hold the erected structure having placed over it one of a number of forms of plastic, fabric or hybrid covers to form, e.g., a tent or other generally water tight enclosure. The ropes inside the collapsible frame structure of the present invention provide the hold down function simply by the weight of the cover over the structure, or alternatively, if, e.g., because of high winds, etc. weighted bags filled with, e.g., sand or water can be place over the bottom horizontal collapsible members. this can be especially beneficial on surfaces that are exceptionally hard, e.g., pure rock, or exceptionally soft, e.g., sand, where tie downs are difficult if not impossible to anchor. The structure is also adaptable to a large variety of terrains, including relatively steep slopes, and the ability to suspend hammocks from the upper vertices of the structure are not impacted by the structure being on such a slope. Furthermore if the structure, once assembled needs to be moved, e.g., having been initially erected over an ant hill, it can be lifted and moved fully assembled relatively easily due to its rigidity and light weight.

In use the collapsible support structure of the present invention can be a form of rapidly deployable emergency shelter. The ability to hang hammocks from the vertices of the frame enable use in wet conditions even if the frame does not support a covering forming a tent with an integral floor.

In operation the collapsible support structure of the present invention can be erected by the following process. The structure is first removed from the storage bag. The user can simply open the carrying bag and stand the collapsed structure in the vertical collapsed position. The five lower horizontal collapsible members will naturally fall away from the vertical poles, with the upper horizontal collapsible members remaining suspended from the upper ends of the vertical poles. the user can then spread tot lower horizontal collapsible support members to form the lower pent by moving the vertical poles outwardly from the stored compacted assembly. Leaving the upper collapsible horizontal support members in the broken down condition, the user can rigidize the lower horizontal collapsible members to form a rigidized pent at the bottom of the structure. With the apex of the roof poles connected by an apex ring as described above and the upper horizontal collapsible members remaining un-rigidized, and or un-tightened, the roof poles can be moved to above the horizontal plane of the upper horizontal collapsible members. The upper horizontal collapsible members can then be rigidized. Both the lower horizontal collapsible members and upper horizontal collapsible members can be rigidized by, e.g., threading the respective upper or lower flexible circumferential support member, e.g., rope or cable through an anchor ring at the opposite end of the cable or rope and held in place at one of the apexes/vertexes 80*a, b, c, d* and *e* or 82*a, b, c, d* and *e* and tightening the rope or cable by hand or with a mechanical tightened so that the respective horizontal lesser circle is in compression. This can be done, e.g., with the user standing inside of the frame under assembly and holding the roof poles upward to form a roof apex, while tightening the upper collapsible horizontal support members. The upper apexes will be generally centered over the centers of the lower collapsible support members and the upper collapsible structural members will be centered generally over the junctions between the bottom collapsible support structural members.

A further application of the present invention to form a collapsible structure support can include other geodesic structures that are able to be formed and broken down according to the present invention, e.g., icosa, octa, tricon, etc., especially in multi-frequency large structures, e.g., using cables with somewhat heavier hardware. The present invention has been described with respect to preferred embodiments. It will be understood by those skilled in the art that many variations and modification of the disclosed preferred embodiments may be made without changing or departing from the scope and spirit of the present invention, e.g., other forms of sleeves and tubes apart from those illustrated which maintain compression by the abutment of the inner tubes within the outer sleeve may be employed as known in the art, e.g., a sleeve with flouted ends and a more narrow central section such that the tubes coact with the narrowed center portion of the sleeve to create the compressive force. IN addition, the sleeve itself could be the internal tubular structure, e.g., having a protrusion that slides along a slot in one or the other of the two tubes running the length of a collapsible member, e.g., 32*a*, so as to be able to be moved from a position in which the sleeve (now an internally disposed sleeve) slideably internally engages both of the other tubes to one in which it so engages only one of the other tubes, similarly to the configuration as shown in FIG. 5. Other such modifications may be made to the mechanical structural elements of the present invention, e.g., the dowels could be replaced with solid or hollow metal rods, or even generally flat struts, particularly if a hinged construction of the struts is desired, all of which may be made, e.g., of metal, e.g., made of aluminum, and/or the eyelets could be replaced with holes bored through the rigid structural members, whether such are wooden of metal, hollow or tubular or flat in construction. the present invention, therefore, should not be limited to any preferred embodiments disclosed in this application and should be considered described and claimed only through the following claim:

The invention claimed is:

1. A collapsible support structure comprising a plurality of essentially triangular frame sections each including a collapsible tubular member, a first predetermined number of said frame sections arranged upright to form a substantially vertical structural portion including a side wall having a top including a plurality of said collapsible tubular members from at least some of the frame sections forming the side wall, and a base including a plurality of said collapsible tubular member of the other frame sections alternatively forming the side wall, an elongated, continuous flexible tensioning member passing through adjacent, collapsible tubular members in the top to connect adjacent frame sections to each other at corners thereof to form flexible joints at said connected corners, said collapsible tubular members in the top connected from end to end by said flexible tensioning member to form the collapsible tubular members into a polygon configuration having a circumference that is changed upon moving said frame sections from a condition forming the support structure into a collapsed condition, and a second predetermined number of said frame sections forming a roof having an edge in common with the top and including said collapsible tubular members forming the top, said roof being folded into the vertical structural portion as said support structure assumes the collapsed condition.

2. The collapsible support structure of claim 1 where the flexible tensioning member has opposed terminal ends that are drawn together to decrease the circumference of the polygon structure and loosened to increase said circumference.

3. A collapsible support structure comprising a first predetermined number of essentially triangular frame sections, each triangular frame section including a pair of rigid members and a collapsible tubular member, and said triangular frame sections forming a substantially vertical structural portion including a side wall that has a base including the collapsible tubular members from some of the triangular frame sections in said first predetermined number and a top including the collapsible tubular members from other triangular frame sections in said first predetermined number, and a second predetermined number of triangular frame sections forming a roof having an edge in common with the top and including said collapsible tubular members from the top of said side wall, a first elongated, continuous flexible tensioning member passing through adjacent, collapsible tubular members in the top and a second elongated, continuous flexible tensioning member passing through adjacent, collapsible tubular members in the base, said collapsible tubular members in the top connected from end to end by said first flexible tensioning member to form the collapsible tubular members into a polygon configuration having a circumference that is changed upon moving said frame sections from a condition forming the support structure into a collapsed condition, said first and second tensioning members connecting adjacent frame sections to each other at corners thereof to form flexible joints at said connected corners, and said first flexible tensioning member having opposed terminal ends that are drawn together to decrease the circumference of the polygon structure and loosened to increase said circumference so that said roof is folded into the vertical structural portion as said support structure assumes the collapsed condition.

4. The collapsible support structure of claim 3 where the collapsible members are rigidized by tightening the first flexible tensioning member to place said collapsible members in a rigid state and into compression.

5. The collapsible support structure of claim 4 where the second predetermined number of triangular frame sections forming the roof extend upward to form a roof apex while tightening the first flexible tensioning member.

6. A collapsible support structure comprising a plurality of essentially triangular frame sections forming an upright side wall with adjacent frame sections connected at corners, each triangular frame section including a pair of elongated rigid members and a tubular member having a collapsed state and a rigid state, said side wall having a top with an expandable perimeter and a base and comprising said triangular frame sections arranged in a predetermined manner where one triangular frame section is adjacent another triangular frame section and the one frame section has one corner at the top and its other corners along the base and the other frame section adjacent said one frame section has a pair of corners at the base and one corner along the top, said adjacent triangular frame sections having a rigid member in common and said rigid members of the triangular frame sections forming the side wall extending between the top and the base, said triangular frame sections positioned relative to each other so that the tubular members along the top, while in a rigid state, are aligned from end to end, and the tubular members along the base, while in a rigid state, are aligned from end to end, and along the top an elongated, continuous flexible tensioning member passing through adjacent tubular members out an end of one tubular member and into an end of an adjacent tubular member to connect adjacent frame sections to each other at the corners thereof to form from a portion of the tensioning member a flexible joint between adjacent connected corners, said flexible tensioning member upon being tightened, and while said tubular members are in a rigid state, pulls together the tubular members along the top and forms the upright side wall and allowing adjacent ends of adjacent the tubular members to separate and expand the perimeter of the top upon being loosened the tensioning member.

7. The collapsible support structure of claim 6 where a plurality of second interconnected triangular frame sections form a roof that is connected to the side wall by the flexible tensioning member, each of said second triangular frame sections including a pair of elongated rigid members and a tubular member having a collapsed state and a rigid state, said tubular members of said second triangular frame sections being along the top and in common with at least some of the tubular members of the triangular frame sections forming the side wall, said roof extending upward to form a roof apex upon tightening the flexible tensioning member.

8. The collapsible support structure of claim 7 where the second triangular frame sections have corners along the top that are in common with corners of the triangular frame sections forming the side wall and that are along said top, said flexible tensioning member connecting said corners along the top of the triangular frame sections forming the side wall and forming the roof.

9. A collapsible support structure comprising a plurality of interconnected essentially triangular frame sections, each triangular frame section comprising a plurality of strut elements, one of the strut elements of each triangular frame section being collapsible and hollow from one end to another end, said triangular frame sections forming a side wall where adjacent triangular frame sections are inverted with respect to each other so along a top of the side wall a corner of one triangular frame section is between the sides of a pair of triangular frame sections and along a bottom of the side wall one side of said one triangular frame section is along the bottom and between individual corners of the pair of triangular frame sections, a first elongated, continuous flexible tensioning member passing from one collapsible strut element along the top to an adjacent collapsible strut element along the top to connect adjacent frame sections at adjacent corners thereof said first flexible tensioning member extending from end to end through each of the collapsible strut elements and from one collapsible strut element into an adjacent collapsible strut element, said first flexible tensioning member forming a flexible corner joint from a portion of a tensioning member passing between adjacent collapsible strut elements, and a second elongated, continuous flexible tensioning member passing from one collapsible strut element along the base to an adjacent collapsible strut element along the base to connect adjacent frame sections at adjacent corners thereof, said second flexible tensioning member extending from end to end through each of the collapsible strut elements and from one collapsible strut element into an adjacent collapsible strut element, said second flexible tensioning member forming a flexible corner joint from a portion of a tensioning member passing between adjacent collapsible strut elements, said first flexible tensioning member having opposed ends that are connected to tighten the first tensioning member, and while the collapsible strut element is in the rigid state, to pull together the now rigid collapsible strut elements along the top and form the side wall.

10. The collapsible support structure of claim 9 where a plurality of second interconnected triangular frame sections form a roof that is connected to the side wall by the first flexible tensioning member, each of said second triangular frame sections including plurality of strut elements, one of the strut elements of each triangular frame section being collapsible and hollow from one end to another end, said collapsible strut elements of said second triangular frame sections being along the top and in common with at least some of the strut elements of the triangular frame sections forming the side wall, said roof extending upward to form a roof apex upon tightening the flexible tensioning member.

11. The collapsible support structure of claim 10 where the second triangular frame sections have corners along the top that are in common with corners of the triangular frame sections forming the side wall and that are along said top, said first flexible tensioning member passing through all the collapsible strut elements and forming all corners along the top of the triangular frame sections forming the side wall and forming the roof.

12. A collapsible support structure comprising a plurality of essentially triangular frame sections, each including a pair of elongated rigid members and one tubular member having a collapsed state and a rigid state, said triangular frame sections positioned relative to each other to form a frame including a substantially vertical structural portion having a side wall, and a roof attached to the side wall, said side wall having a top with a polygon perimeter comprising a plurality of tubular members interconnected and aligned from end to end while in the rigid state, said tubular members alternating so one tubular member is a side of a triangular frame section forming the roof and an adjacent tubular member is a side of a triangular frame section forming the vertical structural portion, said side wall having a base with a polygon perimeter comprising a plurality of tubular members interconnected and aligned from end to end while in the ridge state, each said tubular members forming the base being one side of the triangular frame sections forming the vertical structural portion, and an elongated, flexible tensioning member having opposed ends, said tensioning member passing from end to end through adjacent tubular members along the top and out an end of one tubular member into an end of an adjacent tubular member to connect adjacent frame sections to each other to form from a portion of the tensioning member a flexible joint at adjacent connected corners, the flexible tensioning member configuring the tubular members along the top into the polygon perimeter by tightening the tensioning member to align the tubular members while in a rigid state and bring the tensioning member into tension by pulling on at least one of the opposed ends and tying the opposed ends together, said polygon perimeter expanding upon loosening the ends so the roof folds inward into the vertical structural portion.

13. The collapsible support structure of claim 12 where the tensioning member is inelastic.

14. A collapsible support structure comprising a side wall forming a vertical structural portion and a roof mounted on the vertical structural portion, said wall and roof comprising a plurality of essentially triangular frame sections, each frame section comprising three strut elements, one of the strut elements of each triangular frame section being collapsible and hollow from one end to another end and the other two strut elements being rigid and non-collapsible, said side wall comprising a first predetermined number of the triangular frame sections and a second predetermined number of the triangular frame sections, said side wall having a base in the form of a polygon entirely of the collapsible strut elements from the first predetermined number of the triangular frame sections and a top in the form of a polygon entirely of the collapsible strut elements from the second predetermined number of triangular frame sections, a first elongated, continuous flexible tensioning member extending from end to end through each of the collapsible strut elements forming the base, and a second elongated, continuous flexible tensioning member extending from end to end through each of the collapsible strut elements forming the top, said tensioning members passing from one collapsible strut element to an adjacent collapsible strut element to connect adjacent frame sections at adjacent corners thereof and forming at each corner, from a portion of a tensioning member passing between adjacent collapsible strut elements, a flexible joint.

15. The collapsible support structure of claim 14 where the collapsible strut elements in the base form into a polygon configuration when in a rigid state, and the collapsible strut elements in the top form into essentially the same polygon configuration as in the base when in a rigid state.

16. The collapsible support structure of claim 14 where the collapsible strut elements include a pair of components that are aligned and placed in compression when the second tensioning member is placed in tension, said second tensioning member having opposed ends that are tied together to place the second tensioning member in tension and unloosened to enable the collapsible strut elements to be collapsed.

17. The collapsible support structure of claim 14 where the roof inverts and folds into the vertical structural portion upon collapsing the collapsible strut elements in the top.

18. A collapsible support structure comprising a side wall forming a vertical structural portion and a roof mounted on the vertical structural portion, said wall and roof comprising a plurality of essentially triangular frame sections, each frame section comprising three strut elements, one of the strut elements of each triangular frame section being collapsible and hollow from one end to another end and the other two strut elements being rigid, said side wall comprising a first predetermined number of the triangular frame sections and a second predetermined number of the triangular frame sections, said side wall having a base in the form of a polygon entirely of the collapsible strut elements from the first predetermined number of the triangular frame sections when said collapsible strut elements are in a rigid state and a top in the form of a polygon entirely of the collapsible strut elements from the second predetermined number of triangular frame sections when said collapsible strut elements are in a rigid state, the polygon configurations of the top and base being essentially the same, a first elongated, continuous flexible tensioning member extending from end to end through each of the collapsible strut elements forming the base, and a second elongated, continuous flexible tensioning member extending from end to end through each of the collapsible strut elements forming the top, said tensioning members passing from one collapsible strut element to an adjacent collapsible strut element to connect adjacent frame sections at adjacent corners thereof and forming at each corner, from a portion of a tensioning member passing between adjacent collapsible strut elements, a flexible joint, said collapsible strut elements including a pair of components that are aligned and placed in compression when the second tensioning member is placed in tension, said second tensioning member having opposed ends that are tied together to place the second tensioning member in tension and unloosened to enable the collapsible strut elements to be collapsed by expanding the perimeter of the top, said roof inverting and folding into the vertical structural portion upon collapsing the collapsible strut elements in the top and expanding the perimeter of the top.

19. A collapsible support structure comprising a plurality of essentially triangular frame sections each including a collapsible tubular member having a rigid state and a collapsed state, said triangular frame sections connected at corners thereof to form a truncated icosahedron frame having a substantially vertical structural portion including a side wall with a top and a base and a roof attached to the vertical structural portion, said frame sections forming the roof having an edge in common with the top and including said collapsible tubular members forming the top, said top and base each formed by five collapsible tubular members aligned from end to end that in a rigid state form a pentagonal configuration, said top having a circumference that is changed upon moving said frame sections from a condition forming the support structure into a collapsed condition, a first elongated, continuous flexible tensioning member extending from end to end through each of the collapsible tubular members forming the base, and a second elongated, continuous flexible tensioning member extending from end to end through each of the collapsible tubular members forming the top, said tensioning members passing from one collapsible tubular members to an adjacent collapsible tubular members to connect adjacent frame sections at adjacent corners thereof and forming at each corner, from a portion of a tensioning member passing between adjacent collapsible strut elements, a flexible joint, said roof being folded into the vertical structural portion as said support structure assumes the collapsed condition.

20. The collapsible support structure of claim 19 where the flexible tensioning member has opposed terminal ends that are drawn together to decrease the circumference of the polygon structure and loosened to increase said circumference.

* * * * *